US010159336B2

(12) United States Patent
Liao et al.

(10) Patent No.: US 10,159,336 B2
(45) Date of Patent: Dec. 25, 2018

(54) ELECTRICALLY-LIFTED COMPUTER DESK AND OFFICE DESK THEREOF

(71) Applicant: Varidesk, LLC, Coppell, TX (US)

(72) Inventors: Liangcheng Liao, Shenzhen (CN); Jianzhong Zhang, Shenzhen (CN); Binghui Wu, Shenzhen (CN); Wei Li, Shenzhen (CN); Xiangzhi Jiang, Shenzhen (CN)

(73) Assignee: Varidesk, LLC, Coppell, TX (US)

( * ) Notice: Subject to any disclaimer, the term of this patent is extended or adjusted under 35 U.S.C. 154(b) by 0 days.

(21) Appl. No.: 15/333,207

(22) Filed: Oct. 25, 2016

(65) Prior Publication Data

US 2018/0084903 A1 Mar. 29, 2018

(30) Foreign Application Priority Data

Sep. 23, 2016 (CN) ..... 2016 1 074710

(51) Int. Cl.
*A47B 9/16* (2006.01)
*A47B 21/02* (2006.01)
(Continued)

(52) U.S. Cl.
CPC ..... *A47B 21/02* (2013.01); *A47B 9/16* (2013.01); *A47B 21/0314* (2013.01);
(Continued)

(58) Field of Classification Search
CPC .. A47B 1/056; A47B 1/04; A47B 1/02; A47B 3/12; A47B 3/06; A47B 87/002;
(Continued)

(56) References Cited

U.S. PATENT DOCUMENTS 3,928,946 A * 12/1975 Wynn ..... B24B 27/0084 254/126
4,714,025 A 12/1987 Wallin et al.
(Continued)

FOREIGN PATENT DOCUMENTS

CA 2570635 * 8/2007
CN 2517300 Y 10/2002
(Continued)

OTHER PUBLICATIONS

CN 202808266 Huang et al Mar. 2013 drawing and abstract.*
(Continued)

*Primary Examiner* — Janet M Wilkens

(74) *Attorney, Agent, or Firm* — Venable LLP; Michele V. Frank; Elizabeth C. G. Gitlin

(57) ABSTRACT

An electrically-lifted computer desk and office desk thereof, wherein the computer desk comprises a bottom plate, a driving mechanism, an intermediate support member, a first side-support member, a second side-support member and a face plate, wherein the driving mechanism is fixedly disposed on the bottom plate; the face plate is fixedly disposed on the first side-support member and the second side-support member; and the driving mechanism drives the face plate to rise or fold via the intermediate support member, the first side-support member and the second side-support member.

18 Claims, 6 Drawing Sheets

(51) Int. Cl.
*A47B 21/03* (2006.01)
*B66F 7/06* (2006.01)

(52) U.S. Cl.
CPC .... *B66F 7/0608* (2013.01); *A47B 2021/0335* (2013.01); *A47B 2200/0042* (2013.01); *A47B 2200/0046* (2013.01)

(58) Field of Classification Search
CPC .. A47B 12/088; F16M 11/24; F16M 11/2014; F16M 11/2092; F16M 11/38; F16M 2200/004; F16M 2200/063
USPC ..... 108/145, 144.11, 93, 96, 116–118, 120, 108/43, 138, 50.01, 50.02, 14, 13, 11, 4, 108/9, 10, 33, 39, 147, 146; 312/208.1, 312/223.3, 306, 312, 194–196; 248/421, 248/562, 588, 585, 431, 432, 439, 280.11, 248/292.11, 919, 920, 923
See application file for complete search history.

(56) References Cited

U.S. PATENT DOCUMENTS 4,984,774 A * 1/1991 Zupancic ..... A61B 6/0457 254/122
5,088,421 A 2/1992 Beckstead
5,101,736 A 4/1992 Bommarito et al.
5,174,223 A 12/1992 Nagy et al.
5,224,429 A 7/1993 Borgman et al.
5,259,326 A 11/1993 Borgman et al.
5,339,749 A * 8/1994 Hirose ..... B23Q 1/5468 108/137
5,343,739 A 9/1994 Curry
5,359,542 A 10/1994 Pahmeier et al.
5,379,655 A 1/1995 Yeakle
5,408,940 A 4/1995 Winchell
5,428,923 A 7/1995 Waggamon
5,495,811 A 3/1996 Carson et al.
5,526,756 A 6/1996 Watson
5,695,173 A 12/1997 Ochoa et al.
5,706,739 A 1/1998 Shaheen et al.
5,809,908 A 9/1998 Catta et al.
6,067,024 A 5/2000 Eckstine et al.
6,101,956 A 8/2000 Keil
6,202,797 B1 3/2001 Skolnick et al.
6,213,575 B1 4/2001 Brin, Jr. et al.
6,220,185 B1 4/2001 Pontoppidan
6,269,753 B1 8/2001 Roddan
6,286,441 B1 9/2001 Burdi et al.
6,343,703 B1 2/2002 Fleagle et al.
6,380,849 B1 4/2002 Eckstine et al.
6,435,110 B1 8/2002 Keil
6,439,657 B1 8/2002 Tholkes
6,473,715 B1 10/2002 Eckstine
6,481,515 B1 11/2002 Kirkpatrick et al.
6,510,803 B1 1/2003 Agee
6,516,478 B2 2/2003 Cook et al.
6,546,880 B2 4/2003 Agee
6,550,724 B2 4/2003 Gosling
6,595,144 B1 7/2003 Doyle
6,615,744 B1 9/2003 Eckstein et al.
6,644,748 B2 11/2003 Tholkes et al.
6,682,030 B2 1/2004 Santoro et al.
6,702,372 B2 3/2004 Tholkes et al.
6,705,238 B1 3/2004 Heckert
6,705,239 B2 3/2004 Doyle
6,726,276 B1 4/2004 Tholkes et al.
6,742,768 B2 6/2004 Alba
6,779,217 B2 8/2004 Fisher
6,814,188 B1 11/2004 Heckert
6,876,303 B2 4/2005 Reeder et al.
6,977,476 B2 12/2005 Koch
6,991,067 B2 1/2006 Dube et al.
7,032,522 B2 4/2006 George et al.
7,038,588 B2 5/2006 Boone et al.
7,048,236 B2 5/2006 Benden et al.
7,049,728 B2 5/2006 Bastholm
7,073,464 B2 7/2006 Keil
7,077,068 B1 7/2006 Agee
7,154,397 B2 12/2006 Zerhusen et al.
7,194,358 B2 3/2007 Callaghan et al.
7,255,671 B2 8/2007 Boone et al.
7,282,884 B2 10/2007 Huber et al.
7,311,657 B2 12/2007 Boone et al.
7,314,010 B2 1/2008 George et al.
7,353,557 B2 4/2008 Ellis et al.
7,357,772 B2 4/2008 McDermott
7,428,882 B2 9/2008 Keil
7,443,302 B2 10/2008 Reeder et al.
7,451,506 B2 11/2008 Kummer et al.
7,480,951 B2 1/2009 Weismiller et al.
7,490,559 B2 2/2009 Bentschneider
7,523,515 B2 4/2009 Allen et al.
7,540,243 B2 6/2009 George et al.
7,568,246 B2 8/2009 Vveismiller et al.
7,661,292 B2 2/2010 Buitmann et al.
7,677,518 B2 * 3/2010 Chouinard ..... A47B 21/02 108/10
7,677,678 B2 3/2010 Mosel et al.
7,679,520 B2 3/2010 Zerhusen et al.
7,690,317 B2 4/2010 Beck et al.
7,712,585 B2 5/2010 Hoth
7,784,128 B2 8/2010 Kramer
7,802,332 B2 9/2010 Kummer et al.
7,827,922 B2 11/2010 Keil
7,862,409 B1 1/2011 Sheppard
7,911,349 B2 3/2011 Zerhusen et al.
8,026,821 B2 9/2011 Reeder et al.
8,051,782 B2 11/2011 Nethken et al.
8,082,857 B2 12/2011 George et al.
8,240,257 B2 8/2012 Frost
8,258,965 B2 9/2012 Reeder et al.
8,276,525 B2 10/2012 Janssen
8,334,779 B2 12/2012 Zerhusen et al.
8,368,545 B2 2/2013 Zerhusen et al.
8,443,761 B2 5/2013 Keil
8,487,774 B2 7/2013 Reeder et al.
8,522,695 B2 9/2013 Ellegaard
8,661,989 B2 3/2014 Tsai et al.
8,674,839 B2 3/2014 Zerhusen et al.
8,683,628 B2 4/2014 Baumann et al.
8,733,508 B2 5/2014 Bacon
8,752,488 B2 6/2014 Moller
8,766,804 B2 7/2014 Reeder et al.
8,819,879 B1 9/2014 Day et al.
8,919,264 B1 12/2014 Lager
8,935,985 B2 1/2015 Hjelm
8,947,215 B2 2/2015 Mandel et al.
8,967,057 B2 3/2015 Quiring et al.
8,991,320 B2 3/2015 DesRoches et al.
9,038,549 B1 5/2015 Zebarjad
9,049,923 B1 6/2015 Delagey et al.
9,084,475 B2 7/2015 Hjelm
9,093,930 B2 7/2015 Koch et al.
9,167,894 B2 10/2015 DesRoches et al.
9,230,421 B2 1/2016 Reeder et al.
9,236,817 B2 1/2016 Strothmann et al.
9,241,574 B2 1/2016 Koch
9,271,567 B2 3/2016 Wu
9,286,441 B2 3/2016 Zerhusen et al.
9,326,597 B2 5/2016 Lukas et al.
9,327,953 B2 5/2016 Sayles
9,332,836 B1 5/2016 Zebarjad
9,340,398 B2 5/2016 Ruth
9,345,318 B2 5/2016 Kollreider et al.
9,409,309 B2 8/2016 Kanjee et al.
9,427,080 B2 8/2016 Wu
9,486,070 B2 11/2016 Labrosse et al.
9,504,316 B1 11/2016 Streicher et al.
9,572,421 B2 2/2017 Klinke
9,593,481 B2 3/2017 Gosling et al.
9,608,557 B2 3/2017 Clausen et al.
9,615,655 B1 * 4/2017 Huang ..... A47B 9/16
9,642,758 B2 5/2017 Koch et al.

(56) References Cited

U.S. PATENT DOCUMENTS

| | | | | |
|---|---|---|---|---|
| 9,655,438 | B1 | 5/2017 | Shoenfeld et al. | |
| 9,666,061 | B2 | 5/2017 | Reeder et al. | |
| 9,675,170 | B2 | 6/2017 | Klinke | |
| 9,700,136 | B1 | 7/2017 | Zebarjad | |
| 2001/0013307 | A1 | 8/2001 | Stone | |
| 2002/0002751 | A1 | 1/2002 | Fisher | |
| 2002/0014951 | A1 | 2/2002 | Kramer et al. | |
| 2002/0044059 | A1 | 4/2002 | Reeder et al. | |
| 2002/0103674 | A1 | 8/2002 | Reeder et al. | |
| 2002/0178501 | A1 | 12/2002 | Cook et al. | |
| 2002/0196141 | A1 | 12/2002 | Boone et al. | |
| 2003/0000435 | A1 | 1/2003 | Keil | |
| 2003/0047388 | A1* | 3/2003 | Faitel | B66F 7/0608 187/214 |
| 2003/0052787 | A1 | 3/2003 | Zerhusen et al. | |
| 2003/0075080 | A1 | 4/2003 | Allen | |
| 2003/0079288 | A1 | 5/2003 | Cook et al. | |
| 2003/0112147 | A1 | 6/2003 | George et al. | |
| 2003/0168646 | A1 | 9/2003 | Lopez Alba | |
| 2003/0221916 | A1 | 12/2003 | Dube et al. | |
| 2004/0040480 | A1* | 3/2004 | Hwang | A47B 3/02 108/145 |
| 2004/0094077 | A1* | 5/2004 | Stone | B66F 17/00 108/147 |
| 2004/0186341 | A1 | 9/2004 | McDermott | |
| 2004/0236174 | A1 | 11/2004 | Boone et al. | |
| 2004/0236175 | A1 | 11/2004 | Boone et al. | |
| 2005/0012430 | A1 | 1/2005 | Bastholm | |
| 2005/0150438 | A1 | 7/2005 | Allen | |
| 2005/0166808 | A1 | 8/2005 | Keil | |
| 2005/0168341 | A1 | 8/2005 | Reeder et al. | |
| 2005/0172869 | A1 | 8/2005 | Schmidt | |
| 2005/0187712 | A1 | 8/2005 | Callaghan et al. | |
| 2005/0217540 | A1 | 10/2005 | Novak | |
| 2005/0247239 | A1 | 11/2005 | Newhouse et al. | |
| 2005/0248239 | A1 | 11/2005 | Newhouse et al. | |
| 2006/0037518 | A1 | 2/2006 | Lopez Alba et al. | |
| 2006/0087166 | A1* | 4/2006 | Trippensee | A61G 5/043 297/338 |
| 2006/0180054 | A1 | 8/2006 | George et al. | |
| 2006/0201448 | A1 | 9/2006 | Keil | |
| 2006/0253982 | A1 | 11/2006 | Kummer et al. | |
| 2006/0261775 | A1 | 11/2006 | Huber et al. | |
| 2006/0266791 | A1 | 11/2006 | Koch et al. | |
| 2007/0034125 | A1* | 2/2007 | Lo | B66F 7/0608 108/145 |
| 2007/0120689 | A1 | 5/2007 | Zerhusen et al. | |
| 2007/0125314 | A1 | 6/2007 | Keil | |
| 2007/0169271 | A1 | 7/2007 | Allen et al. | |
| 2007/0180618 | A1 | 8/2007 | Weismiller et al. | |
| 2007/0180626 | A1 | 8/2007 | Ellis et al. | |
| 2007/0200396 | A1 | 8/2007 | Baumann et al. | |
| 2007/0245977 | A1 | 10/2007 | Keil | |
| 2008/0052831 | A1 | 3/2008 | Weismiller et al. | |
| 2008/0087202 | A1 | 4/2008 | George et al. | |
| 2008/0245279 | A1 | 10/2008 | Pan | |
| 2008/0289544 | A1 | 11/2008 | Buitmann et al. | |
| 2009/0058152 | A1* | 3/2009 | Orlo | B60N 3/004 297/163 |
| 2009/0064416 | A1 | 3/2009 | Kummer et al. | |
| 2009/0096615 | A1 | 4/2009 | Reeder et al. | |
| 2009/0145336 | A1 | 6/2009 | Kenny | |
| 2009/0151073 | A1 | 6/2009 | Kramer | |
| 2009/0241807 | A1 | 10/2009 | George et al. | |
| 2010/0154124 | A1 | 6/2010 | Zerhusen et al. | |
| 2010/0258040 | A1 | 10/2010 | Coble | |
| 2011/0166891 | A1 | 7/2011 | Zerhusen et al. | |
| 2012/0013465 | A1 | 1/2012 | Reeder et al. | |
| 2012/0048151 | A1 | 3/2012 | Moore | |
| 2012/0085267 | A1 | 4/2012 | Kenny | |
| 2012/0102434 | A1 | 4/2012 | Zerhusen et al. | |
| 2012/0126072 | A1 | 5/2012 | Pettersson | |
| 2012/0247228 | A1 | 10/2012 | Lukas et al. | |
| 2012/0319836 | A1 | 12/2012 | Reeder et al. | |
| 2013/0075203 | A1 | 3/2013 | Sayles | |
| 2013/0131870 | A1 | 5/2013 | Zerhusen et al. | |
| 2013/0199420 | A1 | 8/2013 | Hjelm | |
| 2013/0293173 | A1 | 11/2013 | Strothmann et al. | |
| 2013/0300558 | A1 | 11/2013 | Reeder et al. | |
| 2014/0014886 | A1 | 1/2014 | Ruth | |
| 2014/0020606 | A1 | 1/2014 | Benden | |
| 2014/0028168 | A1 | 1/2014 | Klinke | |
| 2014/0096706 | A1 | 4/2014 | Labrosse et al. | |
| 2014/0195057 | A1 | 7/2014 | Zerhusen et al. | |
| 2014/0197666 | A1 | 7/2014 | Koch | |
| 2014/0245583 | A1 | 9/2014 | Kanjee et al. | |
| 2014/0320290 | A1 | 10/2014 | Reeder et al. | |
| 2014/0336822 | A1 | 11/2014 | Kristensen | |
| 2014/0360413 | A1 | 12/2014 | Schenk et al. | |
| 2015/0007756 | A1 | 1/2015 | Kollreider et al. | |
| 2015/0136000 | A1 | 5/2015 | Holtschi et al. | |
| 2015/0216296 | A1 | 8/2015 | Mitchell | |
| 2015/0282607 | A1 | 10/2015 | Lager | |
| 2015/0283012 | A1 | 10/2015 | Koch et al. | |
| 2015/0289641 | A1* | 10/2015 | Ergun | A47B 9/16 108/42 |
| 2015/0368082 | A1 | 12/2015 | Davis et al. | |
| 2016/0000219 | A1 | 1/2016 | Lager | |
| 2016/0051042 | A1 | 2/2016 | Koch | |
| 2016/0081468 | A1 | 3/2016 | Molteni | |
| 2016/0106205 | A1 | 4/2016 | Hall et al. | |
| 2016/0113389 | A1 | 4/2016 | DesRoches et al. | |
| 2016/0117450 | A1 | 4/2016 | Zerhusen et al. | |
| 2016/0148489 | A1 | 5/2016 | Reeder et al. | |
| 2016/0159628 | A1 | 6/2016 | Mohr | |
| 2016/0170402 | A1 | 6/2016 | Lindstrom | |
| 2016/0260019 | A1 | 9/2016 | Riquelme Ruiz et al. | |
| 2016/0309889 | A1 | 10/2016 | Lin et al. | |
| 2016/0353880 | A1 | 12/2016 | Sigal et al. | |
| 2017/0000254 | A1* | 1/2017 | Matlin | A47B 9/16 |
| 2017/0000255 | A1 | 1/2017 | Herring et al. | |
| 2017/0042322 | A1 | 2/2017 | Labrosse et al. | |
| 2017/0055720 | A1 | 3/2017 | Lin et al. | |

FOREIGN PATENT DOCUMENTS

| | | | | |
|---|---|---|---|---|
| CN | 201088272 | Y | | 7/2008 |
| CN | 201210973 | Y | | 3/2009 |
| CN | 102846016 | A | | 1/2013 |
| CN | 202800587 | U | | 3/2013 |
| CN | 202874328 | U | | 4/2013 |
| CN | 102599728 | B | | 7/2014 |
| CN | 103976579 | A | | 8/2014 |
| CN | 203860788 | U | | 10/2014 |
| CN | 203969627 | U | | 12/2014 |
| CN | 104337226 | A | | 2/2015 |
| CN | 204178672 | U | | 2/2015 |
| CN | 204239612 | U | | 4/2015 |
| CN | 104605637 | A | | 5/2015 |
| CN | 204519826 | U | | 8/2015 |
| CN | 204667198 | U | | 9/2015 |
| CN | 105212523 | A | | 1/2016 |
| CN | 206390562 | U | | 8/2017 |
| DE | 202005017874 | U1 | | 2/2006 |
| DE | 102005023812 | A1 | | 12/2006 |
| DE | 102006038558 | A1 | | 4/2008 |
| DE | 102014221265 | A1 | | 4/2016 |
| DE | 202016101126 | | * | 6/2016 |
| DE | 102016101954 | A1 | | 8/2017 |
| EP | 2684834 | A1 | | 1/2014 |
| EP | 2684834 | B1 | | 2/2016 |
| GB | 2140678 | A | | 12/1984 |
| KR | 20100111389 | A | | 10/2010 |
| KR | 101608957 | B1 | | 4/2016 |
| NL | 1006365 | C1 | | 12/1998 |
| WO | 2005/079630 | A1 | | 9/2005 |
| WO | 2012118435 | | * | 9/2012 |
| WO | 2016/030542 | A1 | | 3/2016 |
| WO | 2016/087170 | A1 | | 6/2016 |

(56) References Cited

FOREIGN PATENT DOCUMENTS

| | | | |
|---|---|---|---|
| WO | 2016/139293 | A1 | 9/2016 |
| WO | 2017/133729 | A1 | 8/2017 |

OTHER PUBLICATIONS

CN 104647338 Huang et al May 2015 drawing and abstract.*
Synergy, Energycon, "Perfect Protection Enabled by Anti-Collision Technology," Jul. 31, 2017, retrieved from: URL: https://www.technical-furniture.com/ae/about-us/news/anti-collision-protection.
IAWP-15 Adjustable Height Work Platform, Dec. 31, 2016, retrieved from URL: http://www.absolutee-zup.com/productshawp-15-adjustable-height-work-platform/.
Chinese Office Action in related Chinese Application No. 201610844392.9 dated Jun. 19, 2018.

* cited by examiner

ELECTRICALLY-LIFTED COMPUTER DESK AND OFFICE DESK THEREOF

This application claims priority to Chinese Patent Application Ser. No. CN201621074710X filed 23 Sep. 2016.

FIELD OF THE INVENTION

The invention relates to an electrically-lifted computer desk and office desk thereof which can be used separately or in combination and can be lifted stably with low noise and great bearing power.

BACKGROUND OF THE INVENTION

With the more and more generalization of digital homes, the household life of people are undergoing enormous changes, wherein the incorporation of digital automation design in modern digital homes is becoming the most outstanding advantage. In a household environment, the desk has been incorporated into human lives with multiple functions. On the current stage, the desk is generally used only as a dining table, a computer desk, a study desk and the like. Therefore, the functions of the desk are single at present, and can not satisfy the multi-purpose requirements.

In order to solve the above-mentioned problem, the Chinese patent CN 102599728A discloses a lifting desktop device, comprising a lifting desktop, a screw rod driving mechanism, a first bearer, two push rods and two first support rods, wherein the screw rod driving mechanism comprises synchronization wheels, a synchronization belt, a motor device, two nut sliding blocks and two screw rods; the two nut sliding blocks are respectively sleeved on the two screw rods; the two synchronization wheels are respectively disposed at the same ends of the two screw rods; the synchronization belt is connected with the two synchronization wheels; one of the two screw rods is connected with the motor device; one end of the push rod is pivotally connected with the lifting desktop, and the other end is pivotally connected with the nut sliding block; one end of the first support rod is pivotally connected with the lifting desktop, and the other end is pivotally connected with the first bearer; and the lifting desktop can be lifted upwards or folded downwards under the drive of the motor device. The lifting desktop device of the invention is suitable to be used together with various computer desks, school desks, tea tables and the like for placing a keyboard and a mouse; the lifting desktop is free to be lifted and folded, is compact and flexible, and has strong versatility and practicability.

However, the lifting desktop device has the following problems in use: first, the lifting desktop device can not be used separately, but can only be used together with a support platform; second, the structural design is unreasonable: the adoptions of two screw rods and nuts combination and a plurality of pivot joint points cause extreme instability when in operation and multiple fault points; third, the lifting desktop device can not bear a load: when a certain pressure is applied on the lifting desktop, the whole lifting desktop device will swing front and back, left and right.

BRIEF DESCRIPTION OF THE INVENTION

In order to address the deficiencies of the prior art, the invention provides the society with an electrically-lifted computer desk and office desk thereof which can be lifted stably with low noise and great bearing power.

The technical solution of the invention is: provided is an electrically-lifted computer desk, comprising a bottom plate, a driving mechanism, an intermediate support member, a first side-support member, a second side-support member and a face plate, wherein the driving mechanism is fixedly disposed on the bottom plate; the face plate is fixedly disposed on the first side-support member and the second side-support member; and the driving mechanism drives the face plate to rise or fold via the intermediate support member, the first side-support member and the second side-support member, wherein The driving mechanism comprises a first fixing piece, a second fixing piece, a first guide rod and a second guide rod; the first fixing piece and the second fixing piece are parallel to each other, and are separated by a preset distance; the first guide rod and the second guide rod are parallel to each other, are separated by a preset distance, and form a frame together with the first fixing piece and the second fixing piece; a screw rod is disposed in parallel with the first guide rod at an intermediate position between the first guide rod and the second guide rod of the frame; the two ends of the screw rod are respectively connected with the first fixing piece and the second fixing piece; a driving source is disposed at one end of the screw rod; and the driving mechanism is fixed on the bottom plate via the first fixing piece and the second fixing piece.

As an improvement to the invention, the intermediate support member comprises a nut sliding rod seat, a first side-support piece, a second side-support piece and a transverse link, wherein the nut sliding rod seat is threaded on the first guide rod, the second guide rod and the screw rod of the driving mechanism, and does a reciprocating motion along the first guide rod and the second guide rod with the rotation of the screw rod; the lower end of the first side-support piece is pivotally connected with one end of the nut sliding rod seat; the lower end of the second side-support piece is pivotally connected with the other end of the nut sliding rod seat; and the upper ends of the first side-support piece and the second side-support piece are fixedly connected with the transverse link.

As an improvement to the invention, the first side-support member comprises a third side-support piece, a fourth side-support piece, and a first desktop connecting piece fixedly connected with the face plate, wherein the lower end of the third side-support piece is pivotally connected with the bottom plate; the upper end of the third side-support piece is slidably connected with the first desktop connecting piece; the upper end of the fourth side-support piece is pivotally connected with the first desktop connecting piece; the lower end of the fourth side-support piece is pivotally connected with the middle part of the third side-support piece and one end of the transverse link.

As an improvement to the invention, the second side-support member comprises a fifth side-support piece, a sixth side-support piece, and a second desktop connecting piece fixedly connected with the face plate, wherein the lower end of the fifth side-support piece is pivotally connected with the bottom plate; the upper end of the fifth side-support piece is slidably connected with the second desktop connecting piece; the upper end of the sixth side-support piece is pivotally connected with the second desktop connecting piece; the lower end of the sixth side-support piece is pivotally connected with the middle part of the fifth side-support piece and the other end of the transverse link.

As an improvement to the invention, the bottom plate is hollowed to form a first flanged edge and a second flanged edge; the lower end of the third side-support piece is pivotally connected with the first flanged edge; and the lower end of the fifth side-support piece is pivotally connected with the second flanged edge.

As an improvement to the invention, the first desktop connecting piece comprises a third flanged edge; the third flanged edge is provided with a first guide groove thereon; a first guide wheel is disposed at the upper end of the third side-support piece; and the third side-support piece is slidably connected with the first guide groove via the first guide wheel.

As an improvement to the invention, the second desktop connecting piece comprises a fourth flanged edge; the fourth flanged edge is provided with a second guide groove thereon; a second guide wheel is disposed at the upper end of the fifth side-support piece; and the fifth side-support piece is slidably connected with the second guide groove via the second guide wheel.

As an improvement to the invention, the electrically-lifted computer desk further comprises a keyboard plate; the two sides of the keyboard plate are respectively fixedly connected with the first desktop connecting piece and the second desktop connecting piece, or slidably connected with the first desktop connecting piece and the second desktop connecting piece via a drawer slide assembly.

The invention further provides an office desk provided with the electrically-lifted computer desk.

The invention adopts a frame-shaped driving mechanism and a frame-shaped intermediate support member; and the nut sliding rod seat of the intermediate support member is threaded on the first guide rod, the second guide rod and the screw rod of the driving mechanism, and does a reciprocating motion along the first guide rod and the second guide rod with the rotation of the screw rod. The invention not only has the advantages of stable lifting and low noise, but also has the advantage of great bearing power.

DETAILED DESCRIPTION OF THE INVENTION

Figure 1:
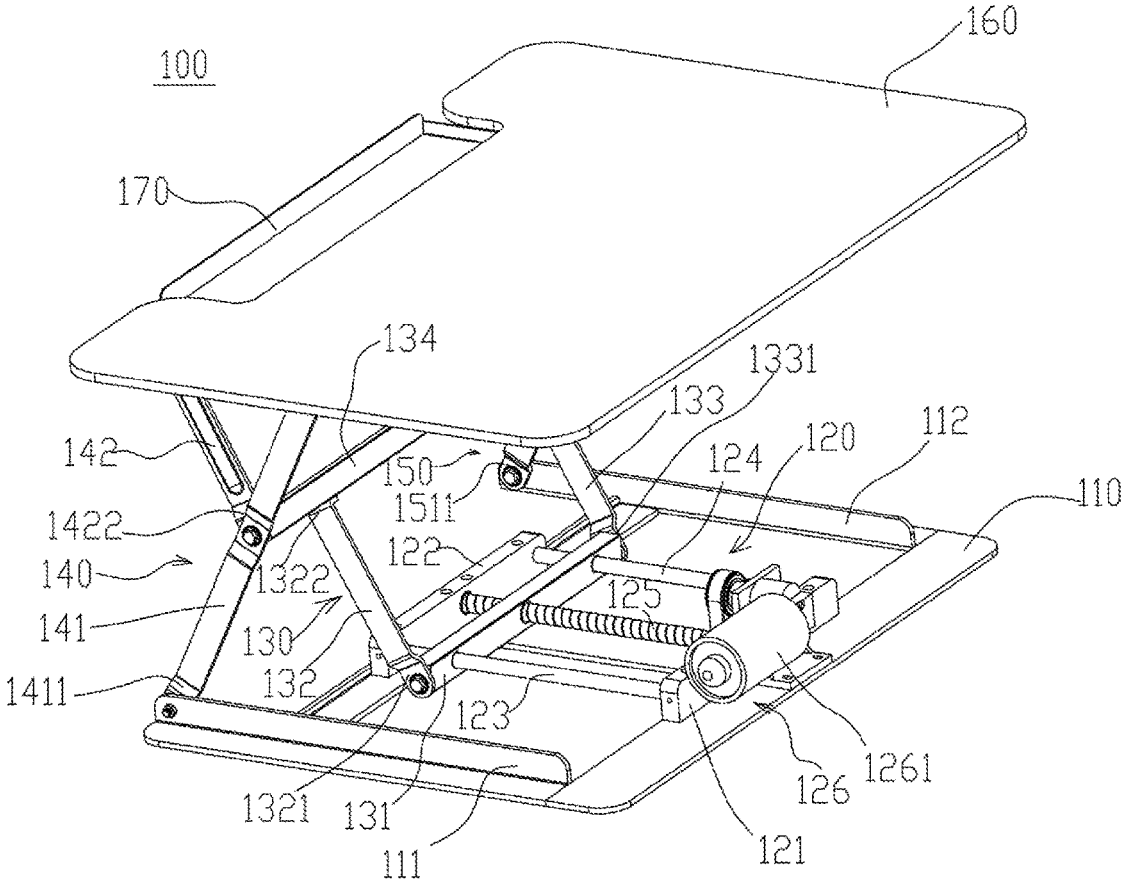
FIG. 1 is a three-dimensional structure schematic diagram of one embodiment of the invention.
Figure 2:
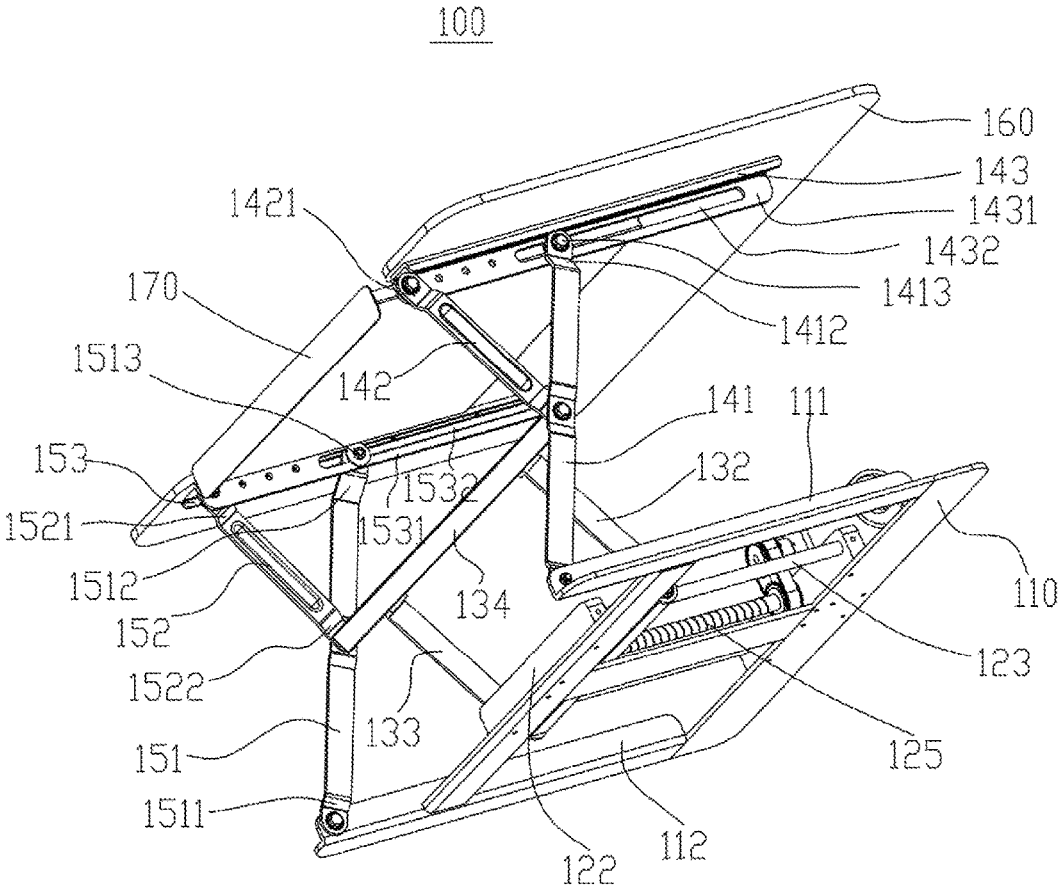
FIG. 2 is a three-dimensional structure schematic diagram of the embodiment in FIG. 1 from another visual angle.

Please refer to FIG. 1-4 which disclose an electrically-lifted computer desk 100, comprising a bottom plate 110, a driving mechanism 120, an intermediate support member 130, a first side-support member 140, a second side-support member 150 and a face plate 160, wherein the driving mechanism 120 is fixedly disposed on the bottom plate 110; the face plate 160 is fixedly disposed on the first side-support member 140 and the second side-support member 150; and the driving mechanism 120 drives the face plate 160 to rise or fold via the intermediate support member 130, the first side-support member 140 and the second side-support member 150, wherein The driving mechanism 120 comprises a first fixing piece 121, a second fixing piece 122, a first guide rod 123 and a second guide rod 124; the first fixing piece 121 and the second fixing piece 122 are parallel to each other, and are separated by a preset distance; the first guide rod 123 and the second guide rod 124 are parallel to each other, are separated by a preset distance, and form a frame together with the first fixing piece 121 and the second fixing piece 122; a screw rod 125 is disposed in parallel with the first guide rod 123 at an intermediate position between the first guide rod 123 and the second guide rod 124 of the frame; the two ends of the screw rod are respectively connected with the first fixing piece 121 and the second fixing piece 122; a driving source 126 is disposed at one end of the screw rod 125; and the driving mechanism 120 is fixed on the bottom plate 110 via the first fixing piece 121 and the second fixing piece 122; the intermediate support member 130 comprises a nut sliding rod seat 131, a first side-support piece 132, a second side-support piece 133 and a transverse link 134, wherein the nut sliding rod seat 131 is threaded on the first guide rod 123, the second guide rod 124 and the screw rod 125 of the driving mechanism 120, and does a reciprocating motion along the first guide rod 123 and the second guide rod 124 with the rotation of the screw rod 125; the lower end of the first side-support piece 132 is pivotally connected with one end of the nut sliding rod seat 131; the lower end of the second side-support piece 133 is pivotally connected with the other end of the nut sliding rod seat 131; and the upper ends of the first side-support piece 132 and the second side-support piece 133 are fixedly connected with the transverse link 134. What should be understood is that when the screw rod 125 is connected with the nut sliding rod seat 131, the screw threads for connecting the nut sliding rod seat 131 with the screw rod 125 can be formed by directly threading the nut sliding rod seat 131, and can also be formed by embedding another nut in the nut sliding rod seat 131; similarly, when the nut sliding rod seat 131 is connected with the first guide rod 123 and the second guide rod 124, a hole can be directly punched on the nut sliding rod seat 131, or a sliding bush can be embedded after punching a hole on the nut sliding rod seat 131. The driving source 126 in the invention can be driven by a motor 1261; when driven by the motor 1261, two different modes are provided: one is that the motor 1261 is directly connected with one end of the screw rod 125 via a speed reducer 1265; and the other one is as shown in the figure: a first synchronization wheel 1262 is disposed on the output shaft of the speed reducer 1265 of the motor 1261, a second synchronization wheel 1263 is disposed at one end of the screw rod 125, and the first synchronization wheel 1262 is connected with the second synchronization wheel 1263 via a synchronization belt 1264. Obviously, if a more environmentally-friendly structure is required to be made, the driving source 126 can be directly driven by manpower, in which case a rocker (unshown in the figure) for applying force is required to be disposed at one end of the screw rod 125. The invention adopts a frame-shaped driving mechanism and a frame-shaped intermediate support member, and transfers the motive power via the frame-shaped intermediate support member. Therefore, the invention has the advantages of stable lifting, low noise and great bearing power.

Preferably, the first side-support member 140 comprises a third side-support piece 141, a fourth side-support piece 142, and a first desktop connecting piece 143 fixedly connected with the face plate 160, wherein the lower end 1411 of the third side-support piece 141 is pivotally connected with the bottom plate 110; the upper end 1412 of the third side-support piece 141 is slidably connected with the first desktop connecting piece 143; the upper end 1421 of the fourth side-support piece 142 is pivotally connected with the first desktop connecting piece 143; the lower end 1422 of the fourth side-support piece 142 is pivotally connected with the middle part of the third side-support piece 141 and one end of the transverse link 134; the second side-support member 150 comprises a fifth side-support piece 151, a sixth side-support piece 152, and a second desktop connecting piece 153 fixedly connected with the face plate 160, wherein the lower end 1511 of the fifth side-support piece 151 is pivotally connected with the bottom plate 110; the upper end 1512 of the fifth side-support piece 151 is slidably connected with the second desktop connecting piece 153; the upper end 1521 of the sixth side-support piece 152 is pivotally connected with the second desktop connecting piece 153; the lower end 1522 of the sixth side-support piece 152 is pivotally connected with the middle part of the fifth side-support piece 151 and the other end of the transverse link 134.

Preferably, the bottom plate 110 is hollowed to form a first flanged edge 111 and a second flanged edge 112; the lower end of the third side-support piece 141 is pivotally connected with the first flanged edge 111; and the lower end of the fifth side-support piece 151 is pivotally connected with the second flanged edge 112.

Preferably, the first desktop connecting piece 143 comprises a third flanged edge 1431; the third flanged edge 1431 is provided with a first guide groove 1432 thereon; a first guide wheel 1413 is disposed at the upper end of the third side-support piece 141; the third side-support piece 141 is slidably connected with the first guide groove 1432 via the first guide wheel 1413; the second desktop connecting piece 153 comprises a fourth flanged edge 1531; the fourth flanged edge 1531 is provided with a second guide groove 1532 thereon; a second guide wheel 1513 is disposed at the upper end of the fifth side-support piece 151; and the fifth side-support piece 151 is slidably connected with the second guide groove 1532 via the second guide wheel 1513.

What should be explained is that when two components are pivotally connected in the invention, a bearing can be assembled at the pivot connecting position, which facilitates the rotation of the invention and reduces noise.

Preferably, the invention further comprises a keyboard plate 170; the two sides of the keyboard plate 170 are respectively fixedly connected with the first desktop connecting piece 143 and the second desktop connecting piece 153, or slidably connected with the first desktop connecting piece 143 and the second desktop connecting piece 153 via a drawer slide assembly.

Figure 3:
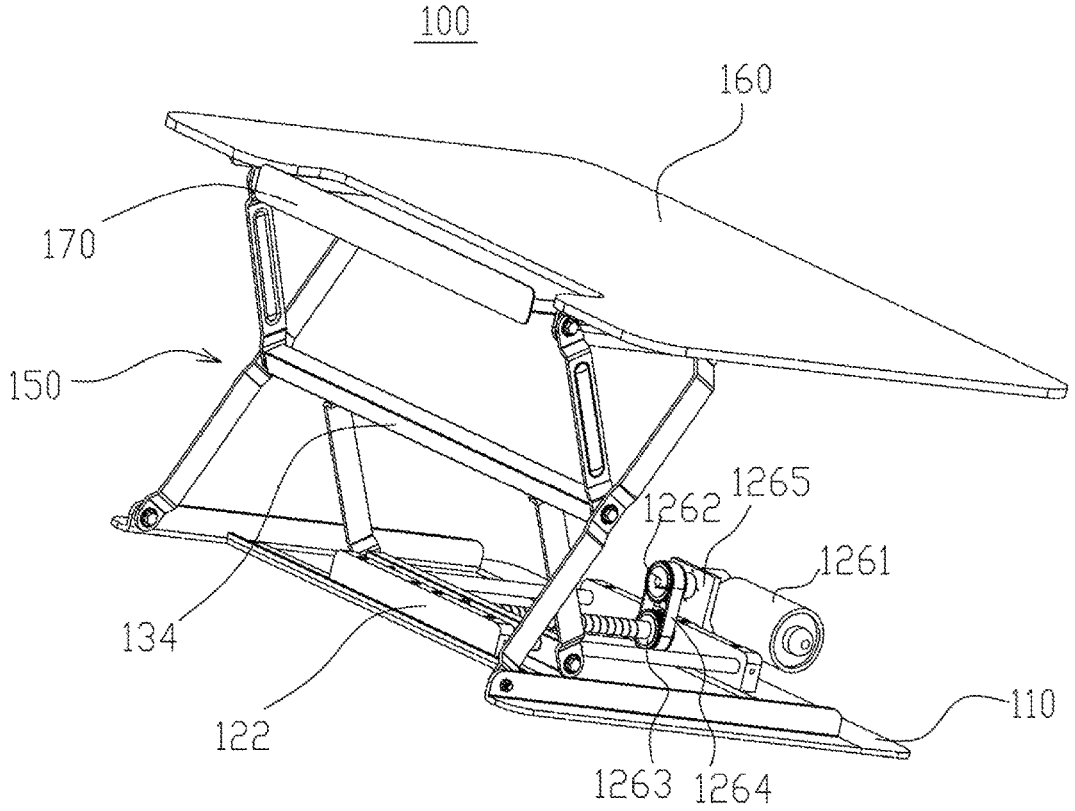
FIG. 3 is a three-dimensional structure schematic diagram of the embodiment in FIG. 1 from a third visual angle.
Figure 4:
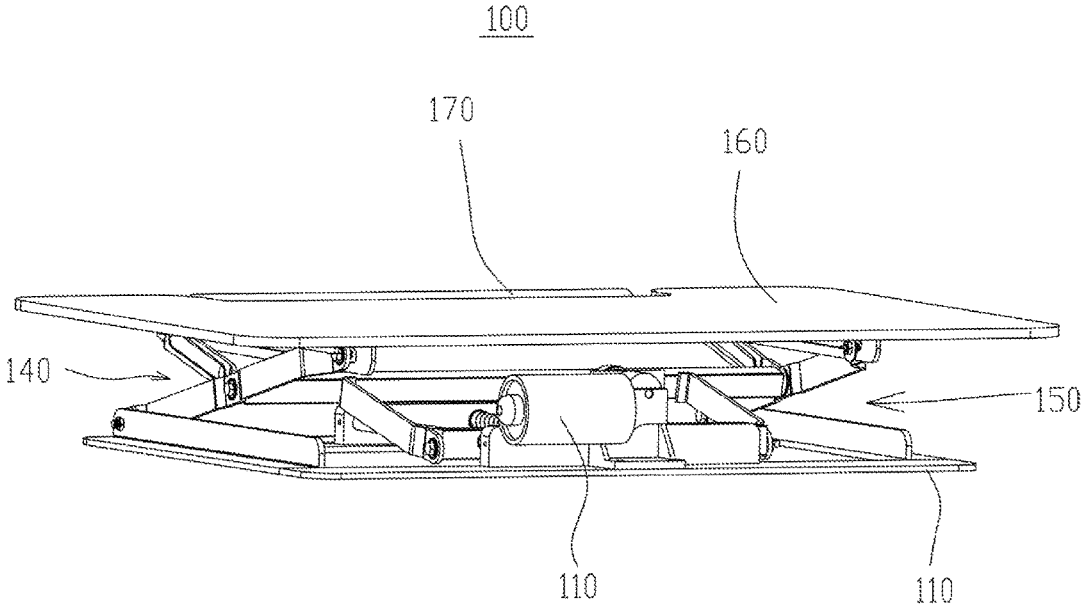
FIG. 4 is a three-dimensional structure schematic diagram of the embodiment in FIG. 1 in a folding state.
Figure 5:
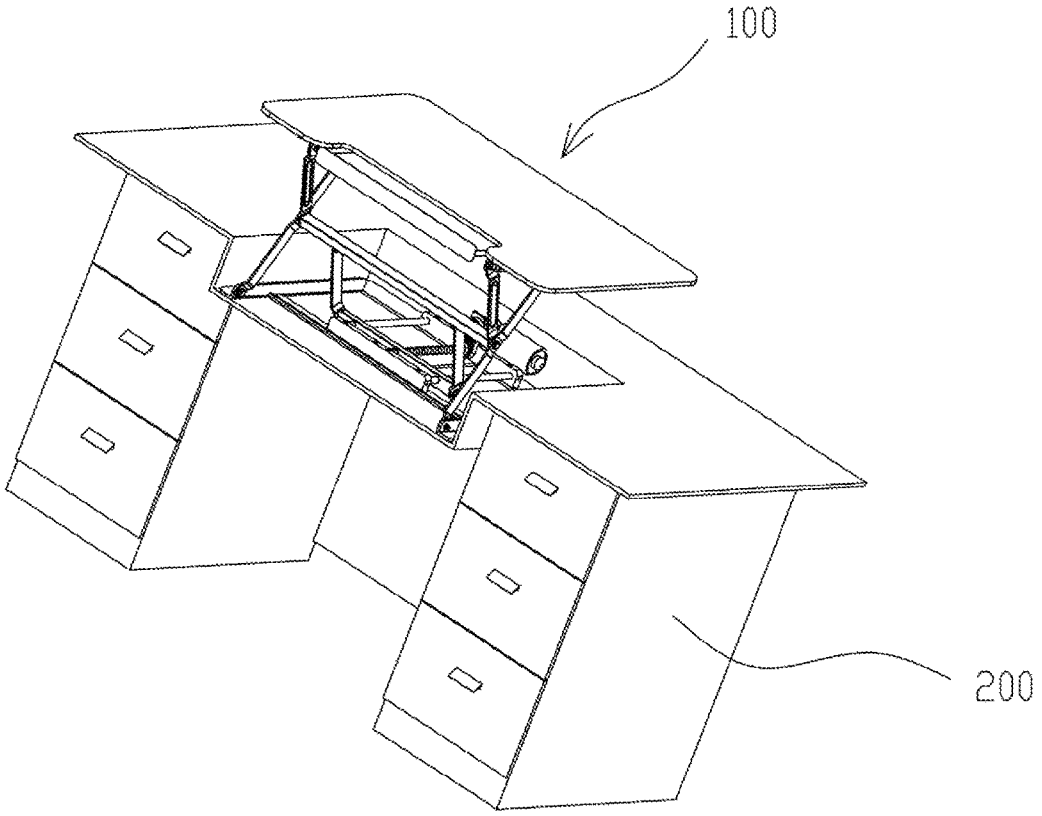
FIG. 5 is a three-dimensional structure schematic diagram of another embodiment of the invention.
Figure 6:
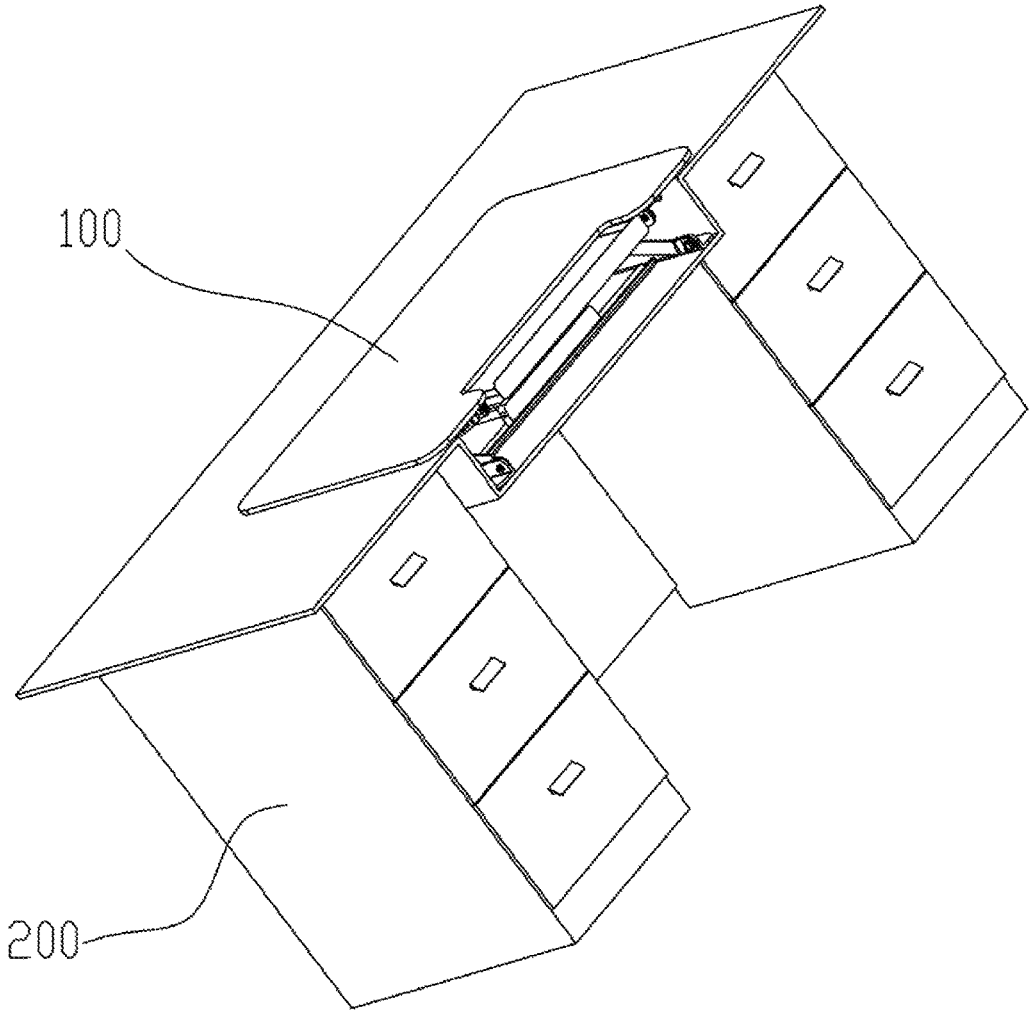
FIG. 6 is a three-dimensional structure schematic diagram of the embodiment in FIG. 5 in a folding state.

Please refer to FIG. 3-4. The invention further provides an office desk; the office desk 200 is provided with the electrically-lifted computer desk 100.

The bottom plate 160 can be directly replaced with an office desk face plate to form an integrative office desk 200 provided with the electrically-lifted computer desk 100; alternatively, the bottom plate 160 can also be maintained, such that the electrically-lifted computer desk 100 can be used separately or in combination with the office desk 200, thus forming a completely novel furniture combination.

What is claimed is:

1. A desk comprising:

a bottom plate;

a first side-support member coupled to the bottom plate;

a second side-support member coupled to the bottom plate;

a face plate coupled to the first side-support member and the second side-support member;

a transverse link coupled to the first side-support member and the second side-support member;

a driving mechanism, the driving mechanism comprising:

a first guide rod;

a second guide rod parallel to the first guide rod;

a screw rod parallel to the first guide rod; and a driving source configured to rotate the screw rod, and a nut sliding rod seat coupled to the transverse link with at least one side-support piece, the nut sliding rod seat configured to move along the screw rod, wherein the driving mechanism is configured to rotate the screw rod moving the nut sliding rod seat to raise and lower the face plate.

2. The desk of claim 1, further comprising:

a first fixing piece; and a second fixing piece parallel to the first fixing piece, wherein the first fixing piece, the second fixing piece, the first guide rod, and the second guide rod form a frame.

3. The desk of claim 2, wherein a first end of the screw rod is connected to the first fixing piece and a second end of the screw rod is connected to the second fixing piece, and wherein the driving source is disposed at the first end of the screw rod.

4. The desk of claim 3, wherein the bottom plate is fixed to the first fixing piece and the second fixing piece.

5. The desk of claim 1, further comprising an intermediate support member, the intermediate support member configured to couple the driving mechanism to the first side-support member and the second side-support member.

6. The desk of claim 5, the intermediate support member further comprising the nut sliding rod seat configured to slide along the first guide rod and the second guide rod.

7. The desk of claim 5, the intermediate support member further comprising the nut sliding rod seat, the at least one side-support piece, and the transverse link, wherein the at least one side-support piece includes a first side-support piece coupled to the nut sliding rod seat and a second side-support piece coupled to the nut sliding rod seat.

8. The desk of claim 7, wherein the first side-support piece includes a lower end pivotally connected with a first end of the nut sliding rod seat, the second side-support piece includes a lower end pivotally connected with a second end of the nut sliding rod seat, and an upper end of the first side-support piece and an upper end of the second side-support piece are fixedly connected with the transverse link.

9. The desk of claim 1, wherein the nut sliding rod seat is coupled to the first guide rod, the second guide rod, and the screw rod, and wherein the nut sliding rod seat is in threaded engagement with the screw rod for reciprocating motion along the first guide rod and the second guide rod upon rotation of the screw rod.

10. The desk of claim 1, wherein the first side-support member and the second side-support member are each slidably coupled to the face plate.

11. The desk of claim 1, wherein the first side-support member and second side-support member each comprise a side-support piece having an upper end and a lower end, wherein the upper end of each side-support piece is pivotally connected to a respective desktop connecting piece fixedly connected with the face plate and wherein the lower end of each side-support piece is pivotally connected to a transverse link.

12. The desk of claim 1, wherein the first side-support member and second side-support member each comprise a side-support piece having an upper end and a lower end, wherein the upper end of each side-support piece is slidably coupled to a respective desktop connecting piece fixedly connected with the face plate and wherein the lower end of each side-support piece is pivotally connected to the bottom plate.

13. The desk of claim 12, further comprising an intermediate support member, the intermediate support member configured to couple the screw rod to the first side-support member and the second side-support member.

14. The desk of claim 13, wherein the intermediate support member comprises the transverse link extending between the first side-support member and the second side-support member.

15. The desk of claim 14, wherein the first side-support member and second side-support member each comprise a second side-support piece having an upper end and a lower end, wherein the upper end of each second side-support piece is pivotally connected to the respective desktop connecting piece fixedly connected with the face plate and wherein the lower end of each second side-support piece is pivotally connected to the transverse link.

16. The desk of claim 14, wherein the intermediate support member further comprises the nut sliding rod seat that slides along the first guide rod and the second guide rod, and is in threaded engagement with the screw rod.

17. The desk of claim 1, wherein the driving source comprises a motor.

18. The desk of claim 1, further comprising a keyboard plate, the keyboard plate coupled with a first desktop connecting piece and a second desktop connecting piece, wherein the first desktop connecting piece and the second desktop connecting piece are fixedly connected to the face plate.

* * * * *